US012305375B1

(12) United States Patent
Chandler

(10) Patent No.: US 12,305,375 B1
(45) Date of Patent: May 20, 2025

(54) ANTI-BACKFLOW PLUMBING FITTING

(71) Applicant: Vista Water Group, LLC, Ashland, OH (US)

(72) Inventor: James W. Chandler, Ashland, OH (US)

(73) Assignee: VISTA WATER GROUP, LLC, Ashland, OH (US)

( * ) Notice: Subject to any disclaimer, the term of this patent is extended or adjusted under 35 U.S.C. 154(b) by 160 days.

(21) Appl. No.: 18/231,285

(22) Filed: Aug. 8, 2023

Related U.S. Application Data

(63) Continuation-in-part of application No. 18/051,695, filed on Nov. 1, 2022, now Pat. No. 11,718,980, which is a continuation of application No. 16/519,200, filed on Jul. 23, 2019, now Pat. No. 11,492,789, which is a continuation-in-part of application No. 15/351,543, filed on Nov. 15, 2016, now abandoned.

(60) Provisional application No. 62/256,917, filed on Nov. 18, 2015, provisional application No. 63/400,177, filed on Aug. 23, 2022.

(51) Int. Cl.
*E03C 1/122* (2006.01)
*E03C 1/182* (2006.01)
*E03C 1/284* (2006.01)

(52) U.S. Cl.
CPC ..... *E03C 1/1222* (2013.01); *E03C 1/182* (2013.01); *E03C 1/284* (2013.01)

(58) Field of Classification Search
CPC ..... E03C 1/1222; E03C 1/182; E03C 1/284
USPC ..... 285/122.1, 125.1, 129.1
See application file for complete search history.

(56) References Cited

U.S. PATENT DOCUMENTS 5,944,985 A * 8/1999 Bowman ..... B01D 61/10 285/125.1
11,479,953 B1 * 10/2022 Chandler ..... E03C 1/102
11,624,176 B1 * 4/2023 Chandler ..... E03C 1/184 285/125.1
11,767,662 B1 * 9/2023 Chandler ..... E03C 1/102 137/215

(Continued)

FOREIGN PATENT DOCUMENTS

WO WO-2014094060 A1 * 6/2014 ..... B29C 64/386

*Primary Examiner* — Lori L Baker
(74) *Attorney, Agent, or Firm* — Ralph E. Jocke; WALKER & JOCKE

(57) ABSTRACT

An anti-backflow plumbing fitting (10, 102) includes an inlet end (16, 108) with a body inlet fitting (20, 118) that is in fluid communication with an inlet passage (40, 122) and an outlet end (18, 110) with a body outlet fitting (30, 144) that is in fluid communication with an outlet passage (48, 152). The body bounds an interior area (36, 106). An axially elongated air gap opening (56, 114) extends through the cylindrical body wall. A further passage (62, 134) extends from outside the body to an internal passage opening (66, 138) that is in an opposed radial direction from the air gap opening. The air gap opening operates to reduce the risk that contaminated liquid may back up into the interior area and reach the inlet passage. A cylindrical outlet end outside wall portion (28) enables the body to be engaged in fluid tight relation with a liquid removal conduit (80). A cylindrical inlet end outside wall portion (26) enables the body to be engaged in fluid tight relation with a liquid delivery conduit (82).

28 Claims, 15 Drawing Sheets

(56) References Cited

U.S. PATENT DOCUMENTS

| | | | | |
|---|---|---|---|---|
| 12,180,690 | B1 * | 12/2024 | Chandler | G01L 19/0007 |
| 2015/0315773 | A1 * | 11/2015 | Mullaney | B29C 64/386 285/125.1 |

* cited by examiner

FIG 16
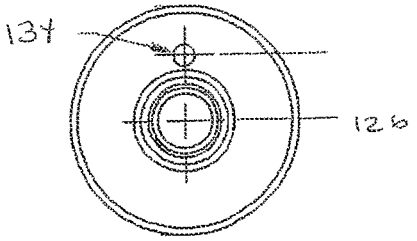
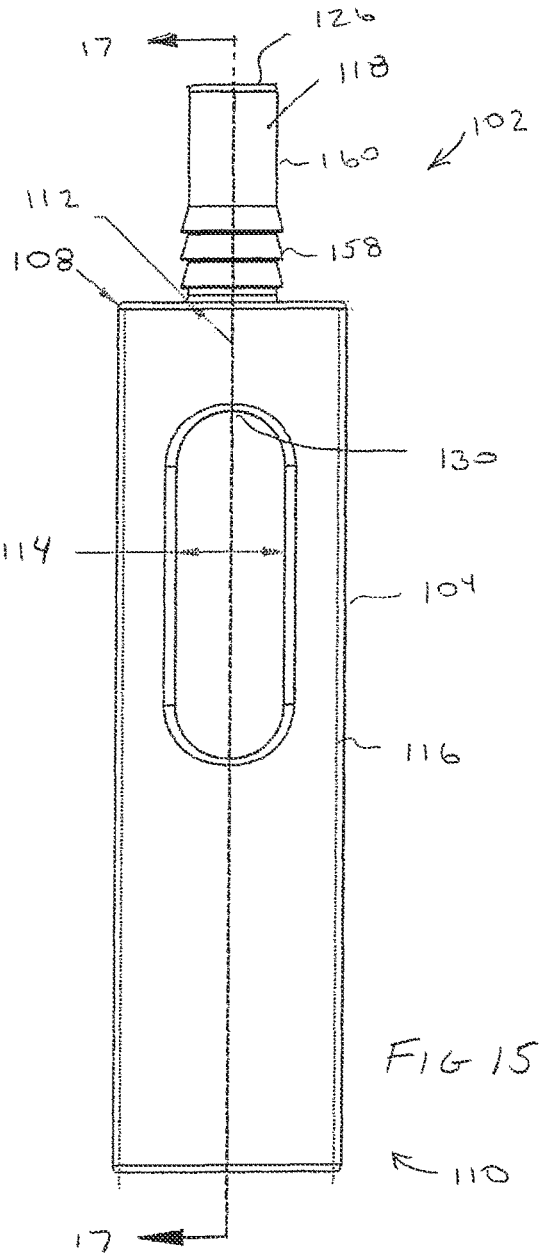
FIG 15
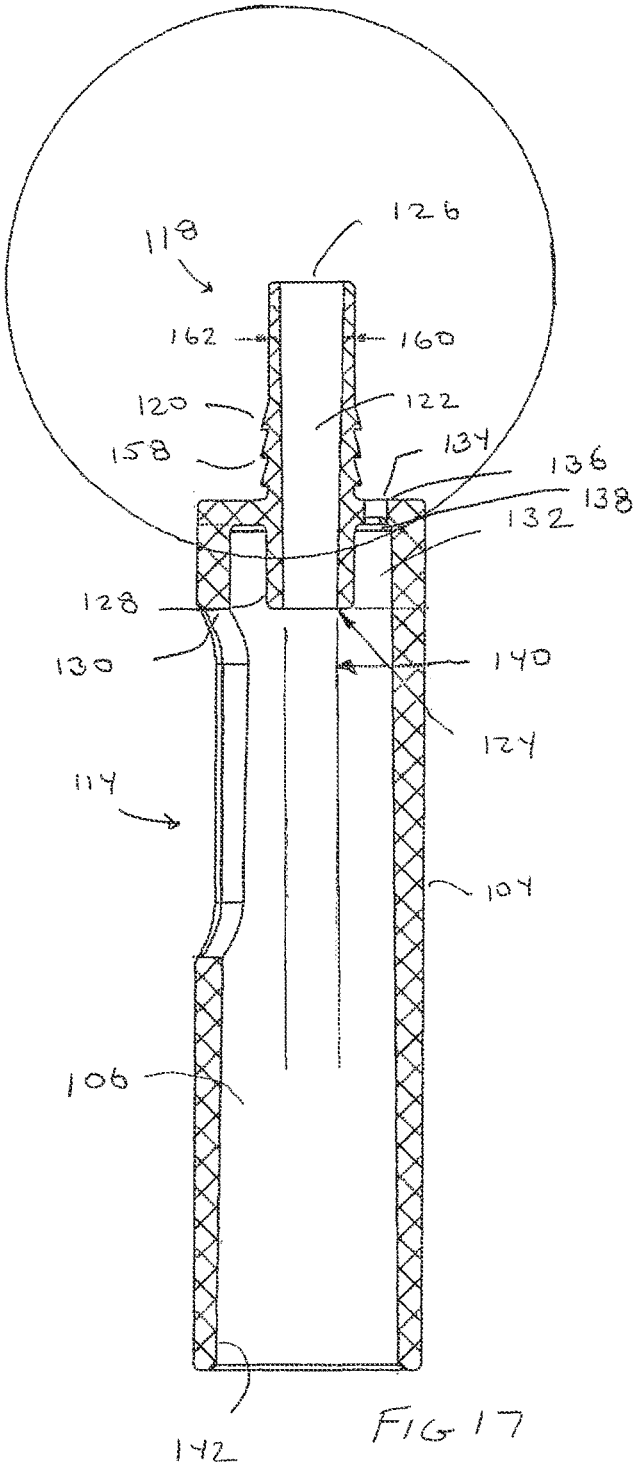
FIG 17

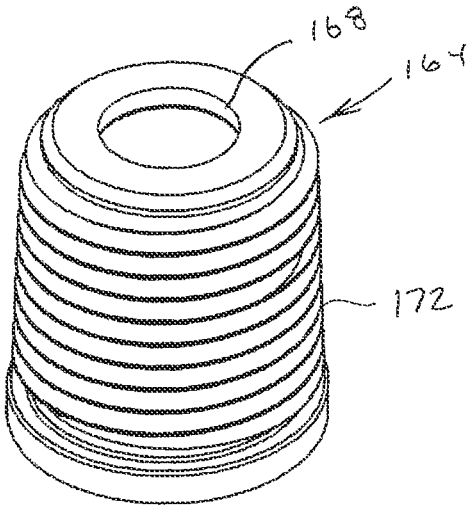
FIG 22
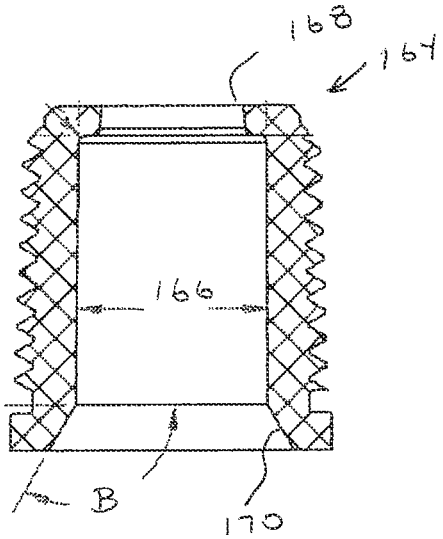
FIG 23
FIG 24
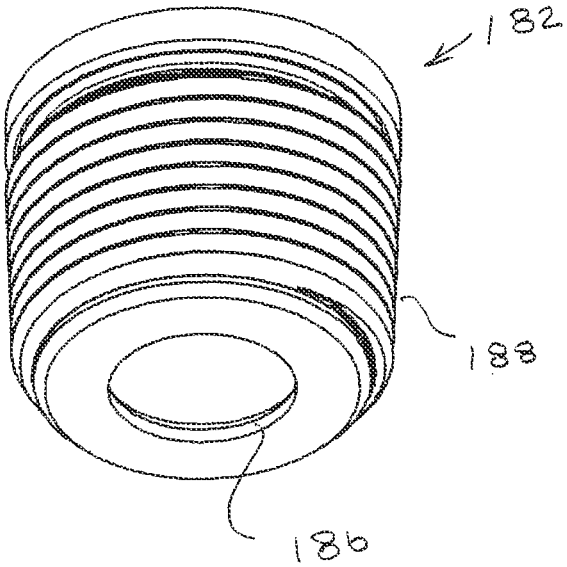
FIG 25
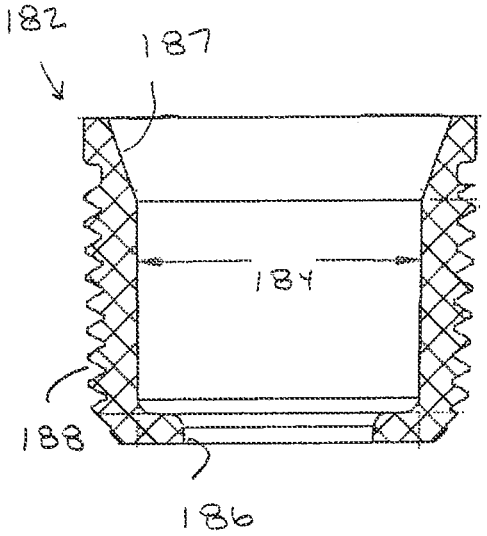

ANTI-BACKFLOW PLUMBING FITTING

TECHNICAL FIELD

This disclosure relates to fittings through which liquid flow is conducted. Specifically, this disclosure relates to a plumbing fitting that enables flow from a liquid discharge device through the plumbing fitting in a direction toward a drain, while preventing backflow through the fitting toward the liquid discharge device.

BACKGROUND

Various types of devices used in commercial and residential facilities utilize or generate liquids that must be discharged to a drain. Many devices utilize or generate liquid water that is discharged to a drain which is connected to a sanitary or storm sewer system. Liquid discharge devices commonly found in commercial and residential facilities include water treatment devices such as water filters and water softeners, heaters, air conditioners, dehumidifiers, humidifiers and other types of devices from which liquid is discharged. Commercial facilities such as manufacturing and service facilities often include the same types of liquid discharge devices as are found in residential environments and may also include other types of liquid discharge devices that are needed to support the specific activities carried out at the facility. Such liquid discharge devices may include devices such as autoclaves, sterilizers, filters, deionizers, instrument cleaners, air compressors, spray cleaning systems and numerous other types of liquid discharge devices.

As liquid discharge devices are fluidly connected with a drain, there is a risk that the drain may become clogged or otherwise cease sufficiently rapid drain flow and the contaminated wastewater may backup into the device. Alternatively, some devices may draw suction on the drain line that draws contaminated water toward the device. For some devices the introduction of contaminated water may cause damage to the device and/or may pose serious health and safety issues.

Numerous devices and systems have been developed to prevent backflow of contaminated liquid from a drain to a liquid discharge device. Such devices and systems may benefit from improvements.

SUMMARY

Exemplary arrangements described herein include an anti-backflow plumbing fitting that prevents backflow of contaminated liquid from a drain to a liquid discharge device that is connected to the plumbing fitting. Exemplary arrangements include an anti-backflow plumbing fitting that has a cylindrical body which bounds an interior area. The body includes axially opposed inlet and outlet ends. The body includes an axially elongated air gap opening that extends in a radial direction from the central axis of the fitting.

An exemplary arrangement further includes a body inlet fitting configured to receive liquid from a liquid delivery line. An inlet passage extends through the body inlet fitting to the interior area. An outlet end body opening delivers liquid from the interior area. In some exemplary arrangements a body outlet fitting is configured to deliver liquid to a liquid removal line. An outlet passage extends from the interior area through the body outlet fitting. In an exemplary arrangement the minimum cross sectional area of the outlet passage is substantially larger than the minimum cross sectional area of the inlet passage. In some arrangements the inlet end includes a further passage. The further passage extends from an external passage opening on the body to an internal passage opening to the interior area. The exemplary internal passage opening is disposed in a further radial direction from the axis that is opposite to the radial direction of the air gap opening.

In some exemplary arrangements the outside wall surface of the exemplary cylindrical body includes a cylindrical inlet end outside wall portion adjacent to the inlet end which is disposed radially outward of the body inlet fitting. The body further includes at the outlet end, a cylindrical outlet end outside wall portion that is radially outwardly disposed of the outlet end body opening. The cylindrical outlet end outside wall portion is configured to be received in fluid tight relation within a cylindrical recess of a fluid receiving liquid removal conduit, such as a rigid coupling or pipe. The cylindrical inlet end outside wall portion is configured to be received in fluid tight relation within a cylindrical recess of a fluid delivering liquid delivery conduit such as a rigid coupling or pipe. In some other exemplary arrangements exemplary inlet and/or outlet fittings may include a cylindrical portion that includes an axially elongated barbed portion and an axially elongated smooth cylindrical portion. The barbed portion is positioned axially closer to the body than the smooth portion. The barbed portion enables the cylindrical portion to be connected to a flexible line such as a hose or tube. The smooth portion can be connected to an external fitting such as an externally threaded adapter which can be fluidly connected to a threaded connector. Thus exemplary arrangements enable the anti-backflow fitting to be fluidly connected at each end through either flexible lines or rigid pipe.

Further features of exemplary arrangements will be described in detail in the following Detailed Description.

BRIEF DESCRIPTION OF DRAWINGS

FIG. 15 is a front view of an anti-backflow plumbing fitting of an alternative arrangement.

FIG. 16 is a top view of the apparatus of FIG. 15.

FIG. 17 is a cross section view taken along line 17-17 in FIG. 15.

FIG. 22 is a perspective view of an externally threaded adapter configured to be installed on the body inlet fitting of the exemplary arrangement of FIG. 15.

FIG. 23 is a cross section view of the adapter shown in FIG. 22.

FIG. 24 is a perspective view of an externally threaded adapter configured to be installed on the body outlet fitting of the exemplary arrangement of FIG. 15.

FIG. 25 is a cross section view of the adapter shown in FIG. 24.

DETAILED DESCRIPTION

Figure 1:
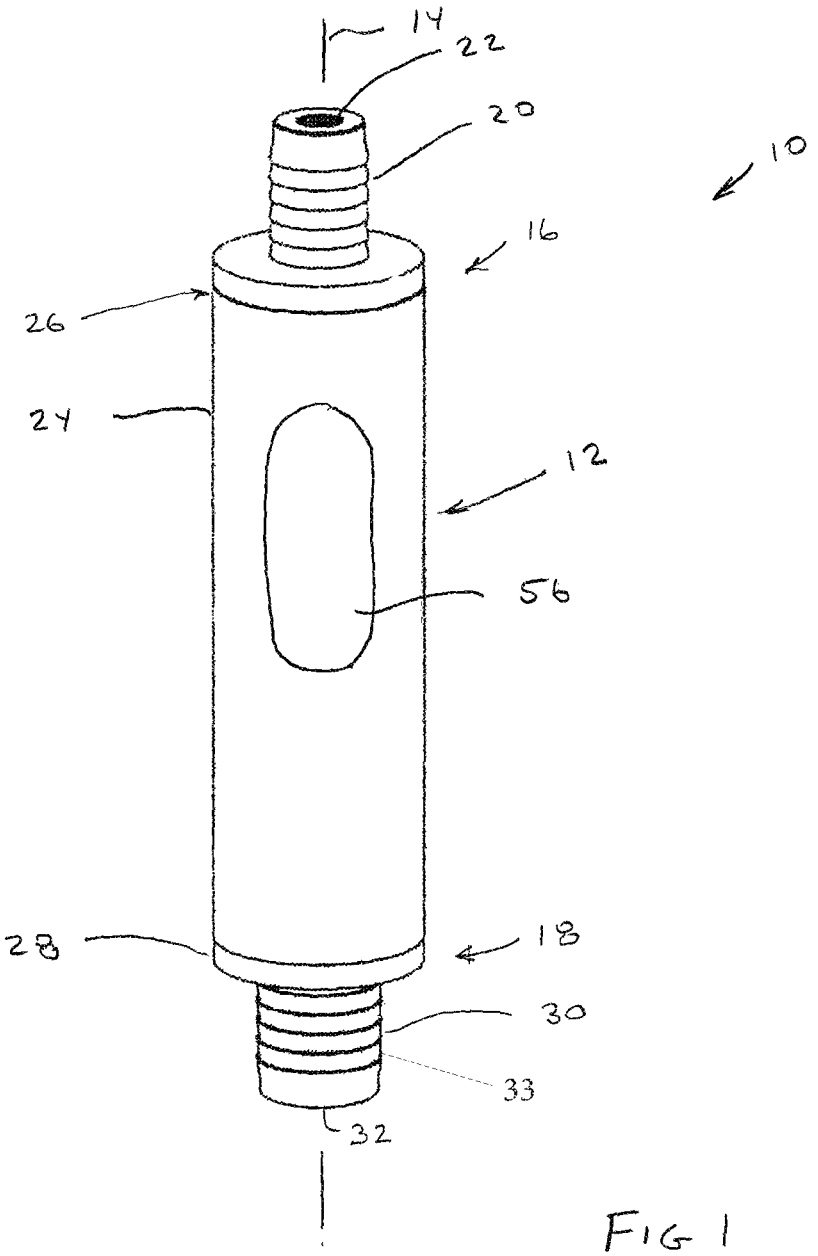
FIG. 1 is a top front perspective view of an exemplary anti-backflow plumbing fitting.
Figure 2:
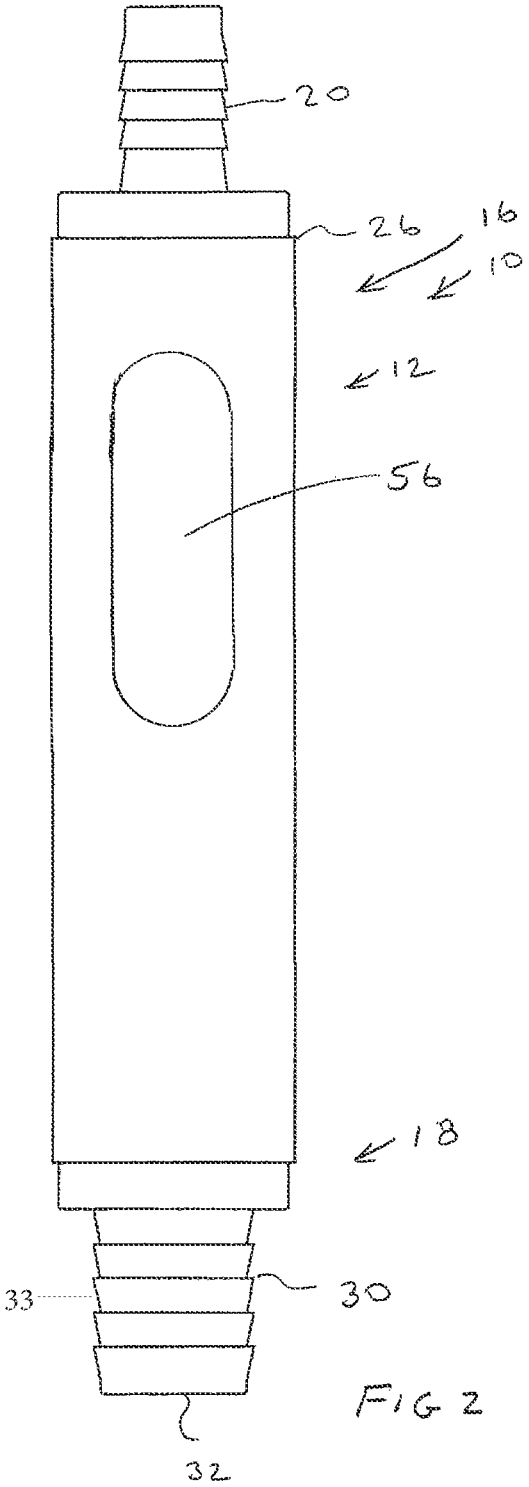
FIG. 2 is a front view of the fitting of FIG. 1.
Figure 3:
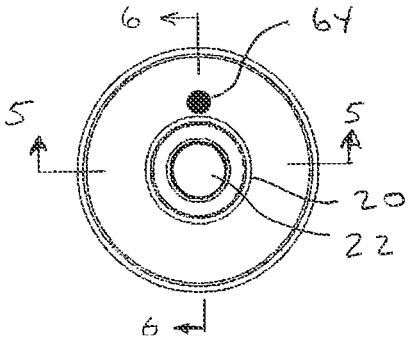
FIG. 3 is a top view of the fitting of FIG. 1.
Figure 4:
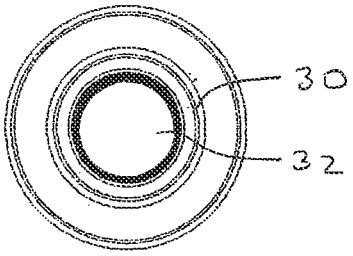
FIG. 4 is a bottom view of the fitting of FIG. 1.

Referring now to the drawings and particularly to FIG. 1 there is shown therein an exemplary apparatus including an anti-backflow plumbing fitting generally indicated 10. The exemplary fitting includes a cylindrical body 12. The cylindrical body extends along a central axis 14. In the operative position of the fitting the axis extends vertically, which for purposes hereof means within ±30° of the vertical direction.

The exemplary fitting includes an inlet end 16 and an outlet end 18. The inlet end includes a body inlet fitting 20 which has a fitting inlet opening 22. Cylindrical body 12 includes an outside wall surface 24. The inlet end 16 further includes a cylindrical inlet end outside wall portion 26 of the outside wall surface 24. The cylindrical inlet end outside wall portion is disposed radially outward from the fitting inlet opening 22 and the body inlet fitting 20. The outside wall surface 24 further includes a cylindrical outlet end wall portion 28 which is adjacent to the outlet end 18. The outlet end further includes an outlet end body opening 25. A body outlet fitting 30 which has a fitting outlet opening 32 is positioned in the outlet end body opening 25. The exemplary body outlet fitting includes an axially elongated cylindrical portion 33 that terminates axially outwardly away from the fitting body in the fitting outlet opening 32. In some exemplary arrangements the body outlet fitting 30 may be fixed within the outlet end body opening 25 and in other arrangements the body outlet fitting may be insertable therein, or alternatively in arrangements where the body of the anti-backflow fitting is connected to a fluid receiving liquid removal conduit in a manner like that later discussed, the body outlet fitting 30 may not be positioned in the outlet end body opening. In the exemplary arrangement the cylindrical outlet end wall portion is disposed radially outward from the fitting outlet opening.

It should be understood that although in this exemplary arrangement the inlet and outlet fittings each include axially elongated cylindrical portions with barbs which serve as barbed connectors suitable to engage a flexible line such as a tube, hose or similar flexible conduit, in other arrangements other types of fittings may be used. These may include threaded fittings, quick connect/disconnect fittings or other types of fittings suitable to engage liquid carrying conduits.

Figure 5:
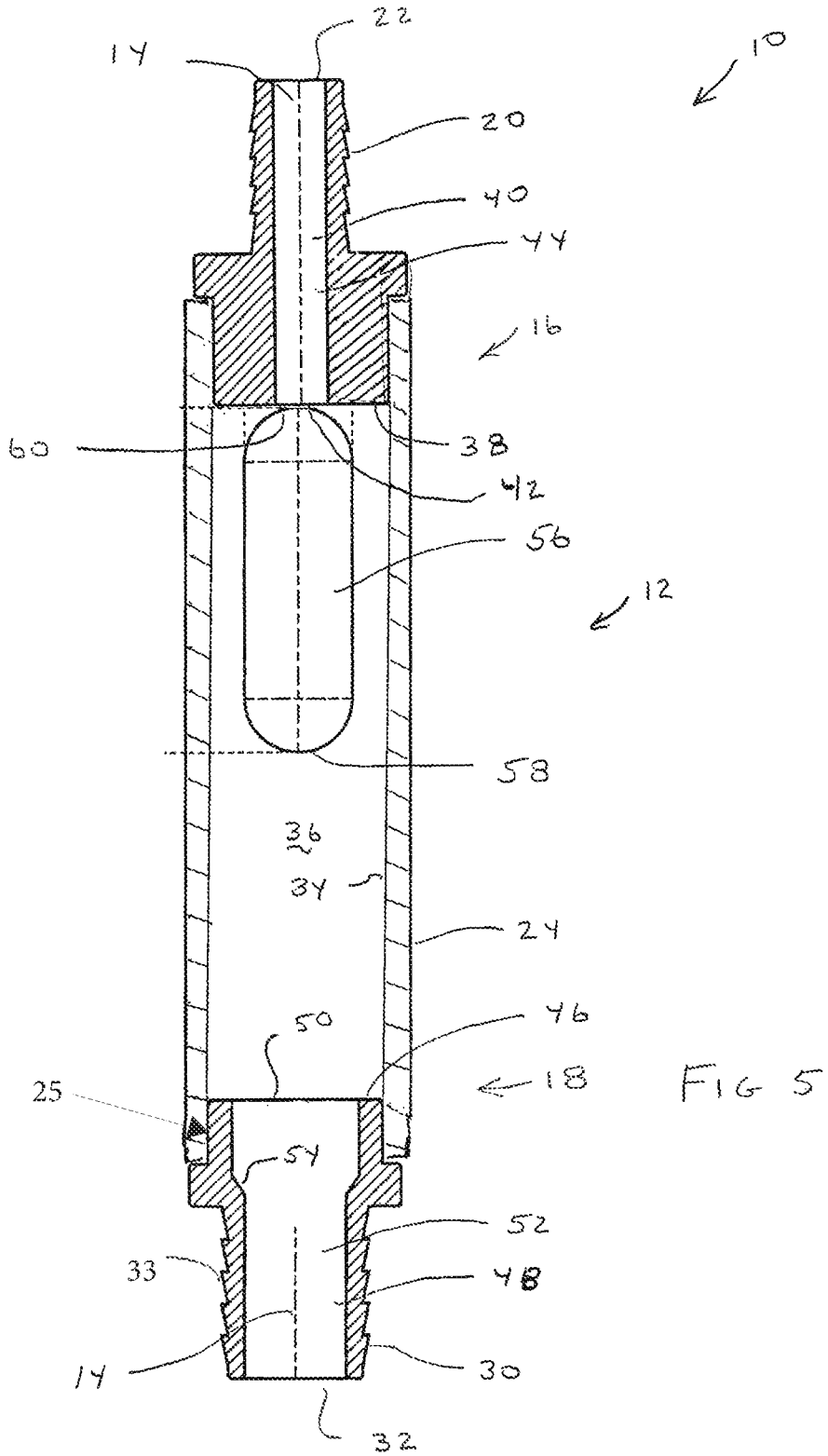
FIG. 5 is a cross sectional view of the fitting taken along line 5-5 in FIG. 3.
Figure 6:
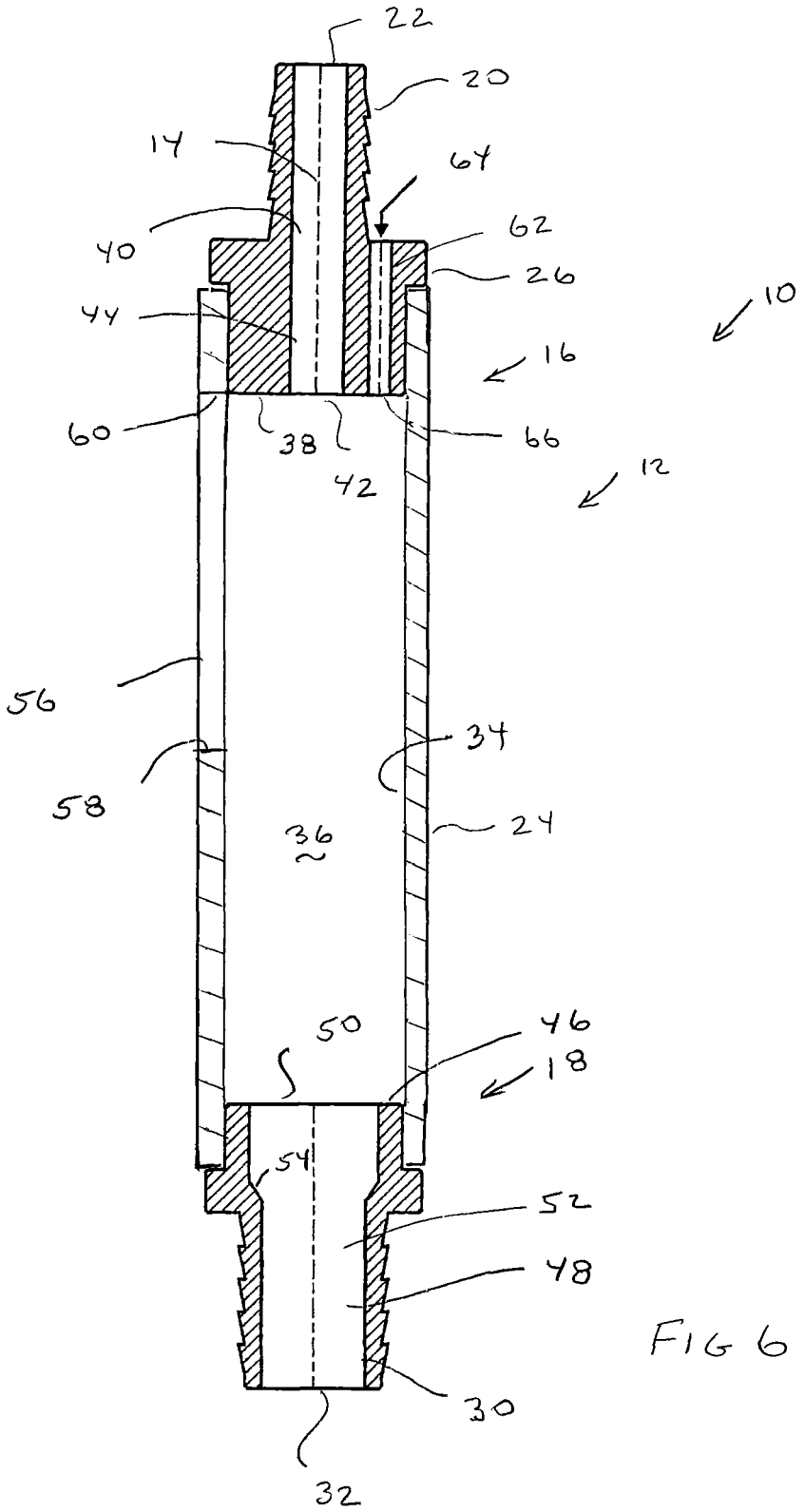
FIG. 6 is a cross sectional view taken along line 6-6 in FIG. 3.

As shown in greater detail in FIGS. 5 and 6 the exemplary cylindrical body 12 includes the outside wall surface 24 and an inside wall surface 34. The inside wall surface 34 radially bounds an interior area 36. The interior area is bounded axially adjacent to the inlet end 16 by a body inlet end wall 38. In the exemplary arrangement the body inlet end wall is integrally formed body inlet fitting 20. An inlet passage 40 extends between the fitting inlet opening 22 of the body inlet fitting 20 and an interior area inlet opening 42 in the body inlet end wall. In the exemplary arrangement the inlet passage 40 extends along the central axis 14. The interior area inlet opening 42 is radially disposed away from the entire inside wall surface 34.

The exemplary inlet passage 40 includes a flow straightening inlet passage portion 44. The exemplary inlet passage portion is circular in axially transverse cross section. In the exemplary arrangement the flow straightening inlet passage 44 is comprised of an elongated axially straight portion of the passage 40 immediately adjacent the interior area inlet opening which is configured to cause fluid to pass out of the interior area inlet opening in a cohesive linear solid stream that is centered with respect to axis 14. Of course it should be understood that this elongated flow straightening passage is exemplary and in other arrangements other features such as straightening vanes, convergent nozzle walls, contoured passage walls, liquid outlet configurations or other features may be utilized in a flow straightening passage for purposes of producing a liquid stream that flows within the interior area in a manner like that later discussed.

The interior area 36 is further bounded at the outlet end by a body outlet end wall 46 which in this exemplary arrangement is integrally formed with the body outlet fitting 30. An outlet passage 48 extends between the fitting outlet opening 32 and an interior area outlet 50 in the body outlet end wall 46. In the exemplary arrangement the outlet passage 48 extends in centered relation along the central axis 14. Further in the exemplary arrangement the outlet passage 48 adjacent the interior area outlet 50 has a greater cross sectional area than a further portion of the passage 52 axially away from outlet 50 that extends through the body outlet fitting 30. A tapered funnel portion 54 is positioned intermediate of the interior area outlet and the further portion 52 of the outlet passage.

In the exemplary arrangement the minimum cross sectional area of the outlet passage 48 is substantially larger than the minimum cross sectional area of the inlet passage 40. This configuration helps to assure that liquid can drain from the interior area 36 at a suitably more rapid rate than the rate at which liquid can enter the interior area. In the exemplary arrangement the cross sectional area of the outlet passage is configured to be at least 2.5 times or 250% of the minimum cross sectional area of the inlet passage. Further in the exemplary arrangement the cross sectional area of the interior area outlet 50 is configured to be at least 1.5 times or 150% of the minimum cross sectional area of the outlet passage. This configuration further helps the liquid to drain from the interior area. Of course it should be understood that this configuration is exemplary and in other arrangements other approaches may be used.

The exemplary cylindrical body 12 includes an air gap opening 56. The exemplary air gap opening extends through the cylindrical side wall and between the inside wall surface 34 and the outside wall surface 24. The exemplary air gap opening comprises a single axially elongated opening with a generally rectangular cross section. Of course this configuration is exemplary and in other arrangements multiple separated air gaps and other air gap configurations may be used. The exemplary air gap opening is bounded vertically in the operative position by a lower gap end surface 58 and an upper gap end surface 60. The exemplary air gap opening 56 has a maximum circumferential width in a range of from 10% to 25% of the circumference of the outside wall surface 24. Further in other exemplary arrangements the circumferential width is between 10% and 17% of the circumference of the outside wall surface. Of course these configurations are exemplary and in other arrangements other approaches and configurations may be used.

The exemplary air gap opening 56 is configured so that in the operative position of the fitting the upper gap end surface is not above the horizontal level of the interior area inlet opening 42. Further in this exemplary arrangement the upper gap end surface 60 is horizontally aligned with the interior area inlet 42. This arrangement helps to facilitate the passage of liquid axially through the interior area 36 without any of the liquid passing out of the air gap opening 56. Further in this exemplary arrangement the interior area 36 has an interior area axial length parallel to the axial direction and between the body inlet end wall 38 and body outlet end wall 46. To provide a holding area for liquid within the interior area and adjacent to the outlet end 18, the lower gap end surface 58 is disposed at least 40% of the total interior area axial length away from the body outlet end wall 46. Further in the exemplary arrangement the air gap opening 56 has a length parallel to the axis of at least 50% of the total interior area axial length. This exemplary configuration provides a suitable gap into which air can enter the interior area 36 through the air gap opening 56, while also providing sufficient area for any liquid that may backup from the fitting outlet opening 32 into the interior area, to pass out of the interior area before reaching the interior area inlet opening 42. Thus, the exemplary configuration of the fitting helps to avoid any contamination of the inlet passage 40 and the devices connected thereto as a result of backflow.

The exemplary fitting 10 further includes a further passage 62 at the inlet end 16. The exemplary further passage 62 extends parallel to the axis 14 between an external passage opening 64 that is open to the outside of the cylindrical body 12. The further passage 62 extends to an internal passage opening 66 that is open to the interior area 36. In the exemplary arrangement the external passage opening 64 is positioned radially intermediate of the outside of the axially elongated cylindrical portion of the body inlet fitting 20 and the fitting inlet opening, and the cylindrical inlet end outside wall portion 26. Further in the exemplary arrangement the internal passage opening 66 is angularly disposed in a radial direction from the axis 14 at least 90° from the center of the axially elongated air gap opening 56.

In the exemplary arrangement shown the internal passage opening 66 is positioned in a radial direction from the axis that is opposite of the radial direction of the center of the air gap opening 56. In the exemplary arrangement the further passage 62 is configured in this manner to provide an additional vent that enables air to enter the interior area 36 when the fitting inlet opening is fluidly connected to a liquid delivery line that is connected directly to the axially elongated cylindrical portion of the body inlet fitting and is mounted in a freestanding manner like that later described. The air entering the device through the further passage assists in causing the liquid to flow more smoothly through the main body of the device. The further passage also serves as a further vacuum breaker in the event that vacuum is drawn on the fitting body through the fitting inlet opening 22. The further passage 62 also enables liquid to pass into the interior area from the outside of the body inlet fitting 20 when the fitting is mounted in fluid tight relation with a fluid delivering liquid delivery conduit in a manner like that later discussed.

Figure 9:
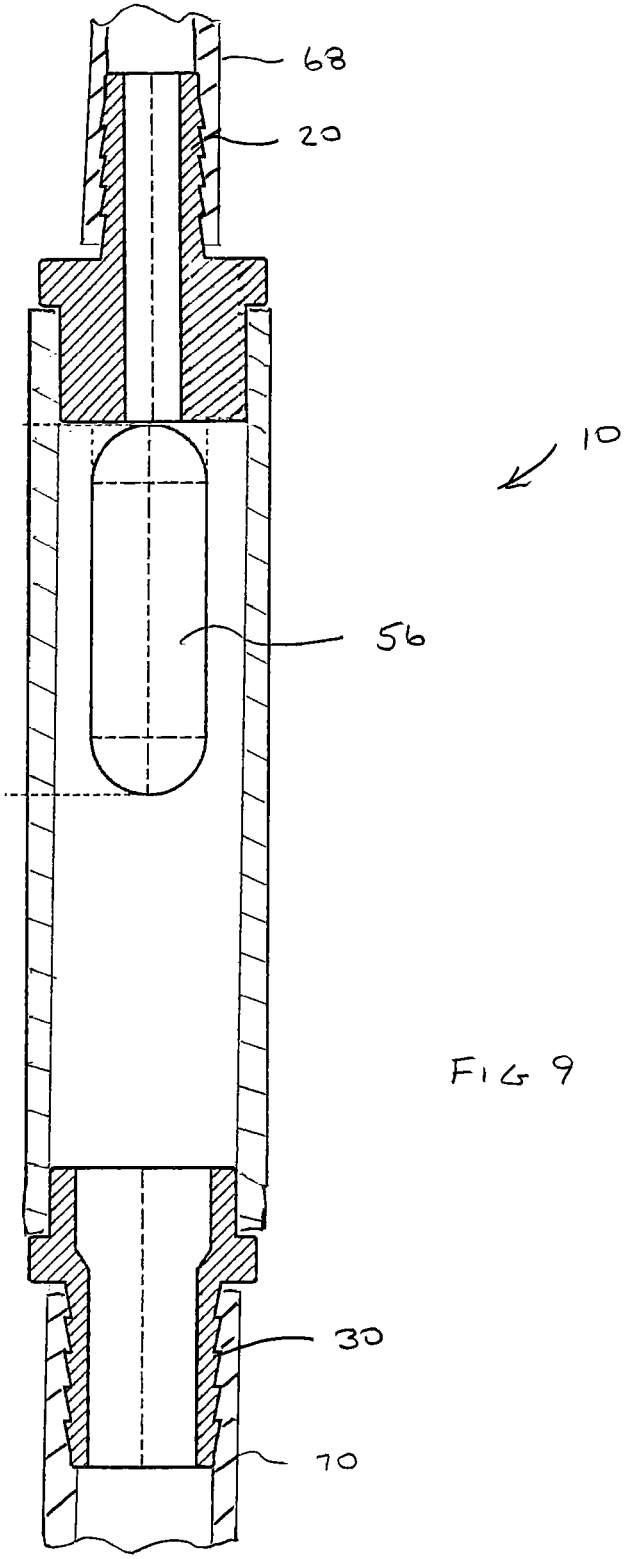
FIG. 9 is a cross sectional view of the fitting of FIG. 1 with a liquid delivery line in engagement with the body inlet fitting and a liquid removal line in engagement with the body outlet fitting.

In this exemplary arrangement the fitting 10 is configured to be used with either flexible lines or rigid conduit. As represented in FIG. 9 the body inlet fitting 20 of the exemplary arrangement is configured to engage a liquid delivery line 68 such as a flexible hose or tube. Likewise the body outlet fitting 30 is configured to engage a liquid removal line 70 which may also be a flexible hose or tube.

Figure 7:
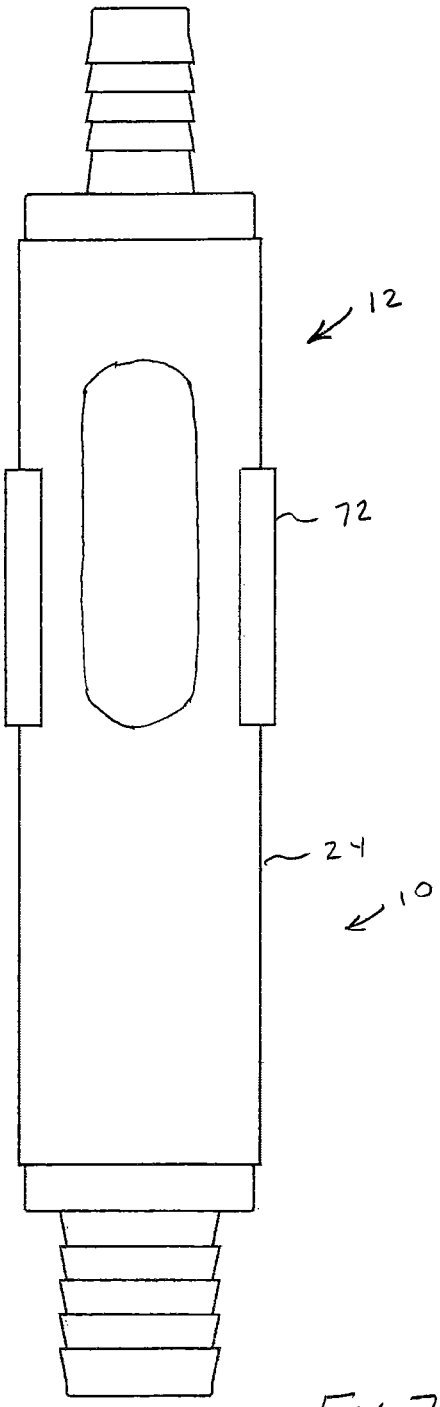
FIG. 7 is a front view of the exemplary anti-backflow plumbing fitting of FIG. 1 in engagement with an exemplary mounting clip.
Figure 8:
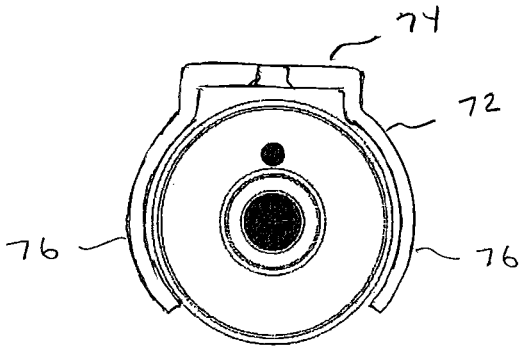
FIG. 8 is a top view of the fitting in engagement with the clip.

When the exemplary fitting 10 is mounted in a freestanding manner it may be supported in connection with a wall or other support through the use of a mounting clip 72 such as is shown in FIGS. 7 and 8. The exemplary mounting clip 72 includes a base portion 74 which is configured to attach to a support. The base portion 74 may include fastener engaging apertures or other similar features to facilitate the engagement of the mounting clip 72 with the support structure. The exemplary clip 72 further includes a pair of disposed deformable arcuate arms 76. The arcuate arms are configured to releasably engage diametrically opposed sides of the outside wall surface 24 of the cylindrical body 12. Of course it should be understood that this mounting clip 72 is merely exemplary of numerous different types of mounting structures that may be utilized for mounting the exemplary fitting 10. Further in some system applications the anti-backflow fitting may be positioned in connection with the fluid lines which provide adequate support to hold the fitting in the desired vertical orientation.

The exemplary fitting 12 is further configured so that the cylindrical outlet end outside wall portion 28 is engageable in fluid tight relation with a cylindrical recess 78 of a rigid fluid receiving liquid removal conduit 80. In the exemplary arrangement shown in FIG. 10 the liquid removal conduit 80 may comprise a rigid coupling or pipe. For example in some arrangements the liquid removal conduit may comprise a plastic pipe to which the cylindrical outlet end wall portion may be joined in cemented engagement. Further in other exemplary arrangements the fluid receiving liquid removal conduit 80 may be comprised of a flexible resilient material that may be engaged in fluid tight relation with the outside wall surface and held in engagement therewith through a suitable clamp or other fastening device.

Figure 10:
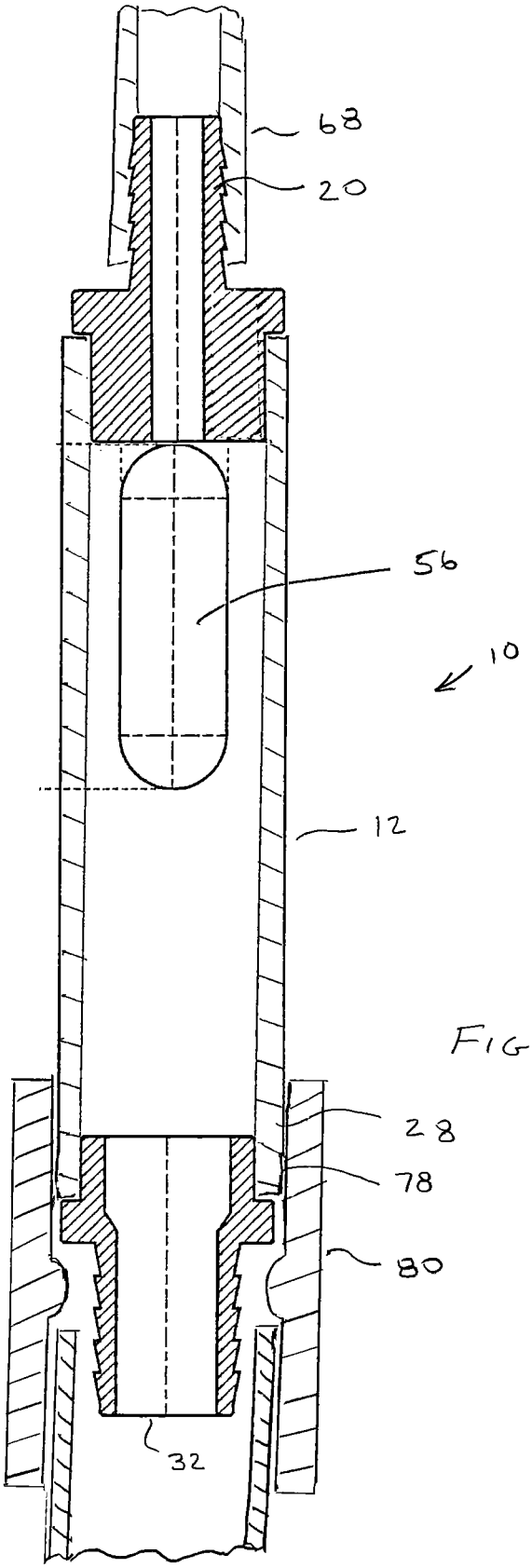
FIG. 10 is a cross sectional view of the fitting of FIG. 1 with a liquid delivery line in engagement with the body inlet fitting and a liquid removal conduit in engagement with the cylindrical outlet end wall portion of the body.

As can be appreciated from FIG. 10 when the fitting 10 is in supported connection with a relatively rigid fluid receiving liquid removal conduit 80, the cylindrical body 12 may be held in the vertical operative position by the conduit 80. Further when the fitting is mounted in this manner the fitting outlet opening 32 is within the interior area of the liquid removal conduit and liquid from the interior area passes from the outlet opening within the conduit. Further in other exemplary arrangements the body outlet fitting 30 may not be positioned in the outlet end body opening 25. In such an exemplary arrangement liquid may pass directly from the interior area 36 of the anti-backflow fitting directly downward into the fluid receiving liquid removal conduit. This approach provides less resistance to outlet flow from the interior area. Further as can be appreciated in the mounting arrangement shown in FIG. 10 the body inlet fitting 20 may be in fluid connection with a liquid delivery line such as a flexible line 68.

Figure 11:
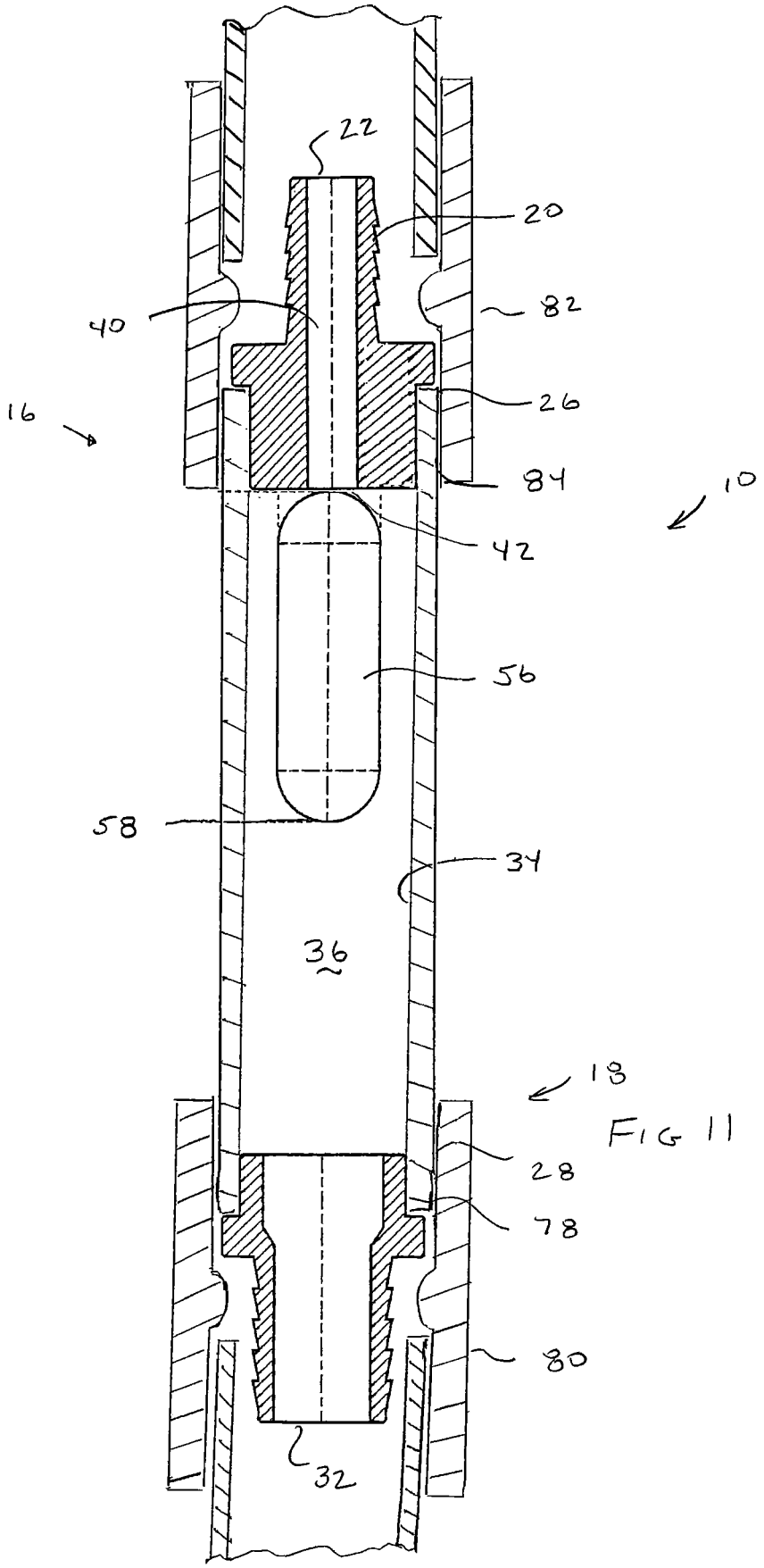
FIG. 11 is a cross sectional view of the fitting of FIG. 1 with a liquid delivery conduit in engagement with the cylindrical inlet end wall portion of the body and a liquid removal conduit in engagement with the cylindrical outlet end wall portion of the body.

As shown in FIG. 11 the exemplary fitting arrangement further enables the fitting body to be engaged in fluid tight relation with a fluid delivering liquid delivery conduit 82. In this exemplary arrangement the cylindrical inlet end outside wall portion 26 is in fluid tight relation with a wall bounding a cylindrical recess 84 of the fluid delivering liquid delivery conduit 82. The cylindrical recess 84 may be a recess in a relatively rigid plastic coupling, pipe or other conduit. Alternatively, the recess may be in a relatively large hose or other conduit. The fitting 10 may be joined in cemented relation with the rigid liquid delivery conduit 82 or held by a clamp in engagement with a flexible conduit. As can be appreciated from FIG. 11 the configuration of the cylindrical body 12 and the cylindrical inlet end wall portion 26 and cylindrical outlet end wall portion 28 enable the exemplary fitting to be mounted in fluid tight engagement with plastic pipe or other types of rigid or flexible conduits.

Further as can be appreciated from FIG. 11 in the exemplary arrangement the further passage 62 which extends parallel to the axis and radially intermediate of the fitting inlet opening 22 and the cylindrical inlet end wall portion 26, enables liquid that would otherwise be held in the annular space above and between the outside of the body inlet fitting 20 and the inside wall bounding the cylindrical recess 84 of the liquid delivery conduit, to pass downward through the further passage 62 into the interior area 36. The configuration of the exemplary arrangement in which this liquid from the liquid delivery conduit 82 passes through the further passage 62 on an opposed radial side of the air gap opening 56, further helps to assure that the liquid is maintained and held within the interior area 36 and does not pass outward through the air gap opening 56. Of course this approach is exemplary and in other arrangements other approaches may be used.

The exemplary anti-backflow plumbing fitting 12 is configured to minimize the risk that liquid that passes through the fitting during normal operation passes outward through the air gap opening 56. This is accomplished in the exemplary arrangement shown by the flow straightening portion 44 of the inlet passage 40. In the exemplary arrangement when the liquid is delivered into the fitting inlet opening 22 of the body inlet fitting 20, the flow straightening passage portion 44 causes a linear stream to be delivered from the interior area inlet 42. In the exemplary arrangement the linear stream is a cohesive linear stream that passes in centered relation along the axis 14 to the portion of the interior area 36 that is axially lower and beyond the lower gap end surface 58 of the air gap opening 56. Thus the exemplary configuration maintains the linear stream radially disposed away from the air gap opening and the inside wall surface 34. Of course it should be understood that this approach is exemplary and in other arrangements other approaches may be used.

Figure 12:
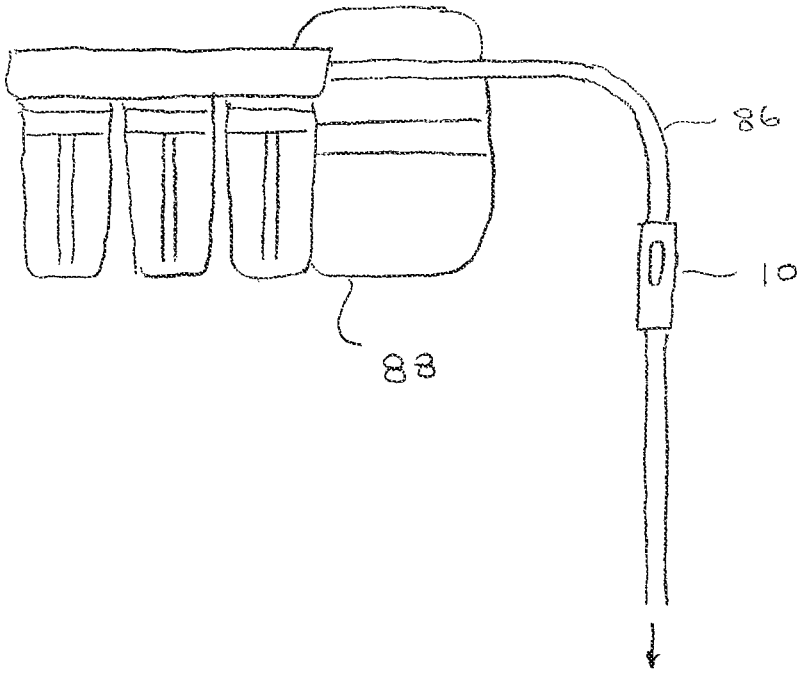
FIG. 12 shows the exemplary fitting of FIG. 1 positioned in a drain line of a reverse osmosis filter.
Figure 13:
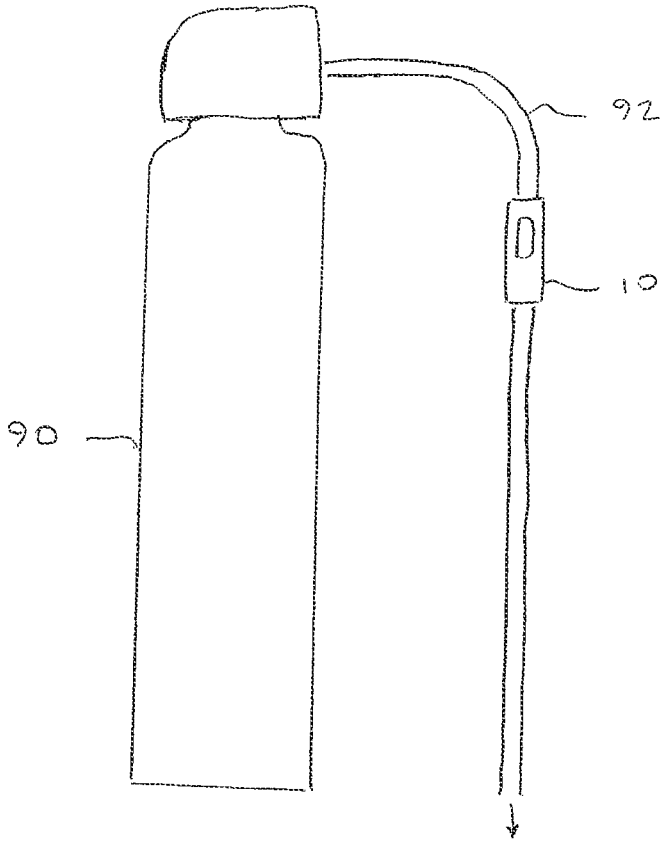
FIG. 13 shows the exemplary fitting of FIG. 1 positioned in a drain line of a whole house filtration unit.
Figure 14:
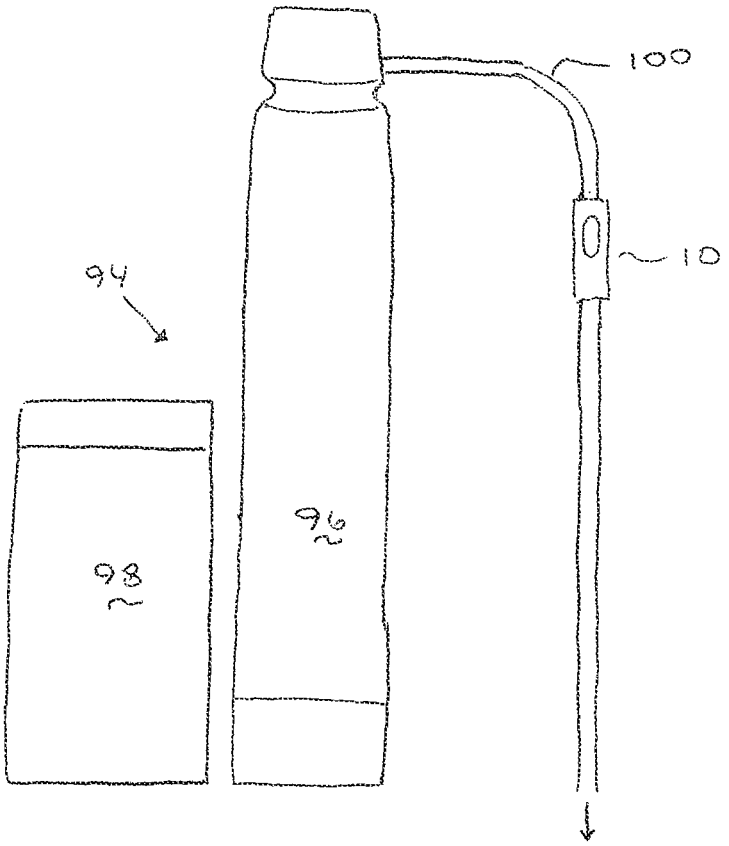
FIG. 14 shows the exemplary fitting of FIG. 1 positioned in a drain line of a water softener.

It should be understood that the exemplary arrangements of the anti-backflow plumbing fitting 10 may be produced in numerous different sizes depending on the flow rate and application in which the fitting is used. Some such exemplary applications are represented in FIGS. 12 to 14. For example as represented in FIG. 12 the anti-backflow plumbing fitting 10 may be positioned in a drain line 86 of a reverse osmosis filter 88. In this exemplary arrangement the fitting 10 prevents water that may back up in the drain line from reaching the filter.

An alternative application of the exemplary fitting is represented in FIG. 13. In this exemplary arrangement a whole house filter 90 suitable for filtering water is shown. The exemplary filter 90 includes a drain line 92 in which the fitting 10 is positioned. FIG. 14 shows a water softener system 94. The exemplary system may include multiple tanks such as a tank 96 housing ion exchange resin, a brine tank 98 or other suitable treatment tanks. The exemplary system includes a drain line 100 in which the exemplary fitting 10 may be positioned. Of course it should be understood that these exemplary systems are merely representative of the types of systems in which anti-backflow plumbing fittings having the exemplary configurations and/or features described herein may be utilized.

FIGS. 15-25 show a second exemplary arrangement of an apparatus comprising an anti-backflow plumbing fitting generally indicated 102. The exemplary fitting is the same as fitting 10 except as otherwise discussed. Fitting 102 includes a cylindrical body 104 which bounds an interior area 106. Fitting 102 includes an inlet end 108 and an outlet end 110. In the operative position the fitting 102 extends along a vertically extending central axis 112. An axially elongated air gap opening 114 extends through the cylindrical side wall 116. The center of the air gap opening 114 extends in a first radial direction from the axis.

A body inlet fitting 118 extends from the inlet end 108 of the body 104. The body inlet fitting includes an axially elongated cylindrical inlet portion 120. A flow straightening inlet passage 122 extends axially in the inlet portion 120. The inlet passage 122 terminates in the interior area at an interior area inlet opening 124. The inlet passage 122 terminates axially outwardly in a fitting inlet opening 126. In this exemplary arrangement the interior area inlet opening 124 is positioned at the inward end of an annular pipe portion 128. The interior area inlet opening in this exemplary arrangement is radially aligned with the upper gap end surface 130 of the air gap opening 114. An axially extending annular internal recess 132 extends in surrounding relation of the annular pipe portion 128 in the interior area inlet opening 124.

Similar to the previously described arrangement a further passage 134 extends in the inlet end. Further passage 134 includes an external passage opening 136 that is externally exposed on the body of the fitting. The further passage 134 further includes an internal passage opening 138. The internal passage opening 138 is fluidly connected to the interior area 106 similar to the previously described arrangement. The further fluid passage 134 is positioned radially from the axis 122 in a direction opposed of the direction from the axis to the center line of the air gap opening 114.

In this alternative arrangement the further passage opening 138 is open to the axially extending annular internal recess 132. This may provide benefits in terms of facilitating air being drawn into the interior area of the body by the flow of the linear fluid stream 140 shown schematically passing from the interior area inlet opening 124. In exemplary arrangements the air entering the annular recess surrounding the annular pipe portion 128 may help to maintain the coherent nature of the linear liquid stream as it passes axially downward in the interior area to below the air gap opening.

Further in this exemplary arrangement the presence of the annular pipe portion 128 transversely between the further passage opening 138 and the air gap opening may help to prevent liquid from moving toward the air gap opening from the further passage 134 when the anti-backflow fitting is mounted in a cylindrical recess of a fluid delivery conduit in the manner previously discussed. In addition when the anti-backflow fitting is mounted with its inlet end engaged with a fluid delivering liquid delivery conduit, liquid that passes through the further passage 134 is enabled to adhere to and follow the annular pipe portion 128 in a downward direction toward the outlet 110. Of course it should be understood that this approach is exemplary and other arrangements other approaches may be used.

Similar to the previously described arrangement, the outlet end 110 includes an outlet end body opening 142. The outlet end body opening 142 is configured to receive a body outlet fitting 144 therein. The exemplary body outlet fitting 144 may be similar to the body outlet fitting previously described in that includes a cylindrical portion 146 that is positionable in engaged relation with the body 104 within the outlet end body opening 142. The body outlet fitting 144 further includes a body outlet end wall 148 that axially bounds the interior area when the body outlet fitting is positioned in the outlet end body opening. The body outlet fitting 144 further includes an interior area outlet 148. The exemplary body outlet fitting 144 further includes an axially elongated cylindrical outlet portion 150 in which an outlet passage 152 extends. The outlet passage terminates at a fitting outlet opening 154. Similar to the previously described arrangement, the fitting outlet opening 154 is positioned axially outward beyond the outlet end and the cylindrical side wall 116 of the body.

Figure 18:
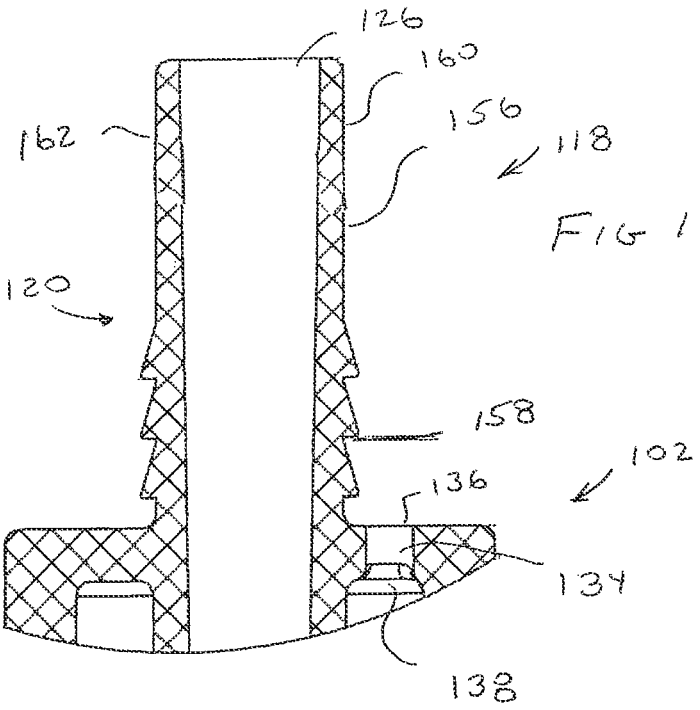
FIG. 18 is a cross section view of the body inlet fitting and body inlet end of the apparatus of FIG. 15.
Figure 19:
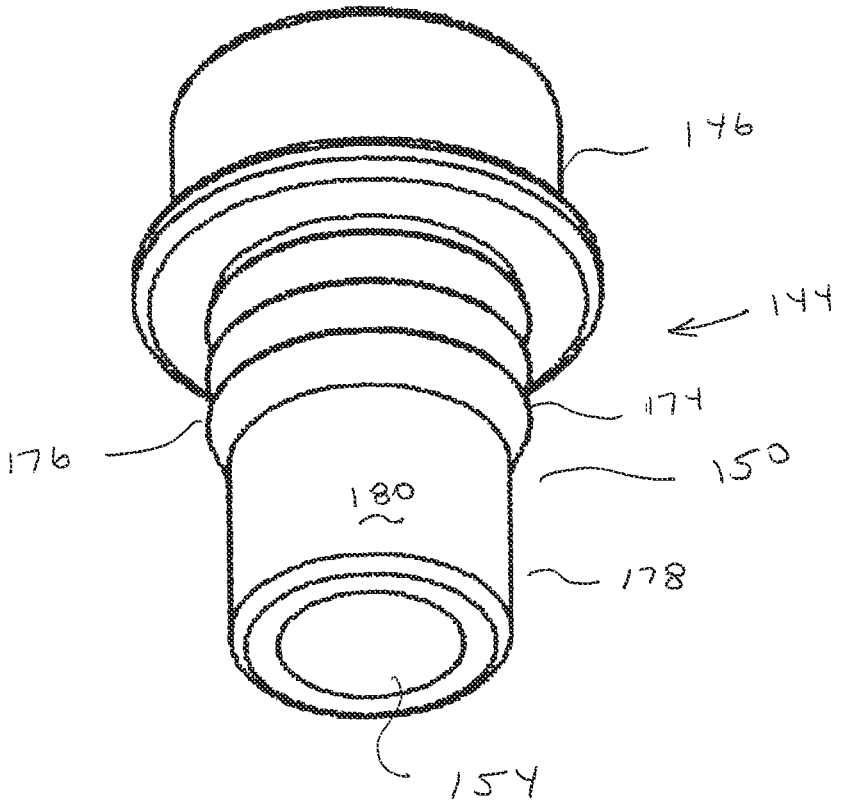
FIG. 19 is a perspective view of a body outlet fitting that may be used with the apparatus shown in FIG. 15.

As shown in greater detail in FIG. 18 in the exemplary anti-backflow fitting 102 the axially elongated inlet portion 120 of body inlet fitting 118 includes a cylindrical inlet portion outer surface 156. Outer surface 156 includes an axially elongated barbed portion 158. The barbed portion includes a plurality of axially spaced annular radially outward extending barbs. The exemplary outer surface 156 further includes an axially elongated smooth portion 160. The exemplary smooth 160 has a smooth elongated cylindrical outer surface 162. In the exemplary arrangement the barbed portion 158 is positioned axially closer to the body 104 than the smooth portion 160. Further in the exemplary arrangement the smooth elongated cylindrical outer surface 162 has a slight taper such as 5° or less relative to the axis, with the larger diameter of the surface being positioned at the beginning of the barbed portion.

The exemplary configuration of the body inlet fitting 118 is suitable for fluidly engaging the fitting with a flexible liquid delivery line such as hose or tube. This is done by engaging the interior diameter of the line with the smooth portion and barbed portion 158 of the fitting. The exemplary smooth portion 160 is configured to engage an externally threaded inlet adapter 164 such as is shown in FIGS. 22 and 23. The exemplary inlet adapter 164 includes an internal axially extending bore 166 that terminates externally at an inlet opening 168. The bore 166 is slightly tapered in a manner that generally corresponds to the taper of the smooth cylindrical outer surface 162 of the smooth portion 160. An angled annular land surface 170 is positioned at an opposed end of the bore from the inlet opening 168. The land surface 170 extends in an angle B which in the exemplary arrangement corresponds to the angle of the first radially outward extending barb on the barbed portion 158. The inlet adapter includes a threaded outer surface 172 that is configured to correspond to a threaded fluid connector. In exemplary arrangements the inlet adapter 164 may be attached to the body inlet fitting 118 using a suitable adhesive or other fastening means. Of course it should be understood that this approach is exemplary and in other arrangements other approaches may be used.

In the exemplary arrangement the body outlet fitting 144 includes the axially elongated cylindrical outlet portion 150 which has a cylindrical outlet portion outer surface 174. Similar to the body inlet fitting, the cylindrical outlet portion outer surface 174 includes an axially elongated barbed portion 176. The exemplary barbed portion includes a plurality of axially spaced annular radially outward extending barbs. The cylindrical outlet portion outer surface 174 further includes an axially elongated smooth portion 178 which includes a smooth cylindrical outer surface 180. Similar to the body inlet fitting the smooth cylindrical outer surface 180 may have a slight taper with its largest diameter adjacent to the barbed portion 176.

In the exemplary arrangement the smooth portion 178 and the barbed portion 176 is configured to engage the inside diameter of a flexible outlet line such as a hose or tube. The exemplary smooth portion 178 is configured to engage an adapter such as externally threaded outlet adapter 182. Externally threaded outlet adapter 182 is similar to inlet adapter 164 except that it is a larger size due to the greater area of the outlet passage of the body outlet fitting compared to the inlet passage. The exemplary outlet adapter includes an axially extending bore 184 which is tapered in a manner generally corresponding to the smooth cylindrical outer surface 180. The outlet adapter terminates in an outlet opening 186. The exemplary bore 184 at an axial end opposed of the outlet opening includes an annular tapered land surface 187. The land surface is tapered to correspond to the angle of the outermost part of the barbed portion 176. The outlet adapter 182 further includes a threaded outer portion 188. The exemplary threaded outer portion is configured to engage a female thread of a delivery connector. In exemplary arrangements the outlet adapter 182 may be in fixed connection with the outlet fitting via adhesive or other similar attaching methods. Of course these approaches and configurations are exemplary and in other arrangements other approaches may be used.

Figure 20:
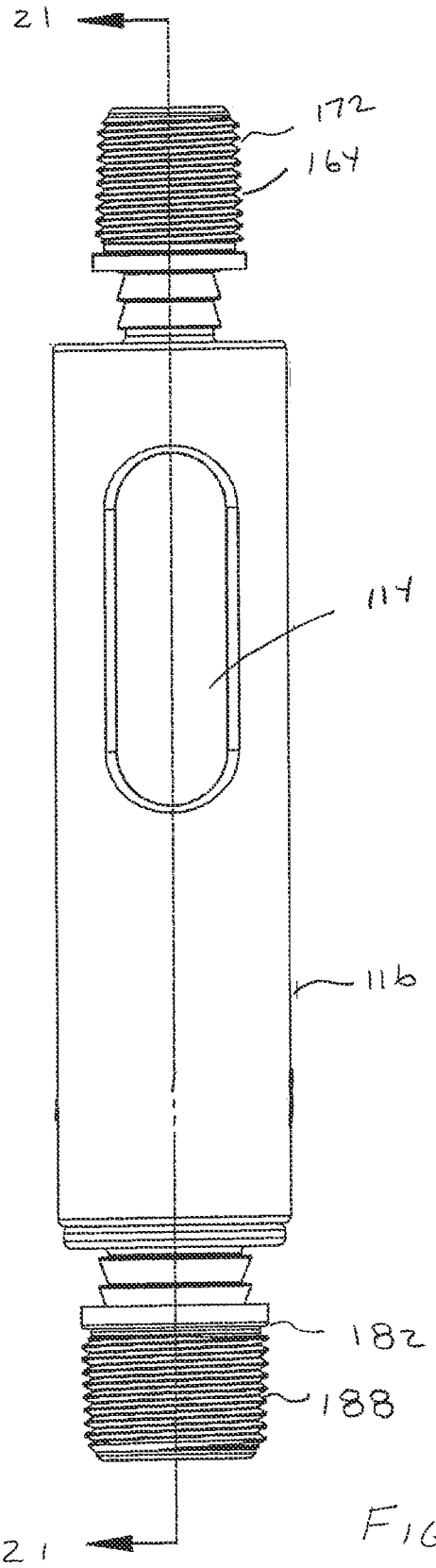
FIG. 20 shows the apparatus of 15 with an externally threaded adapter attached to each of the body inlet fitting and the body outlet fitting.
Figure 21:
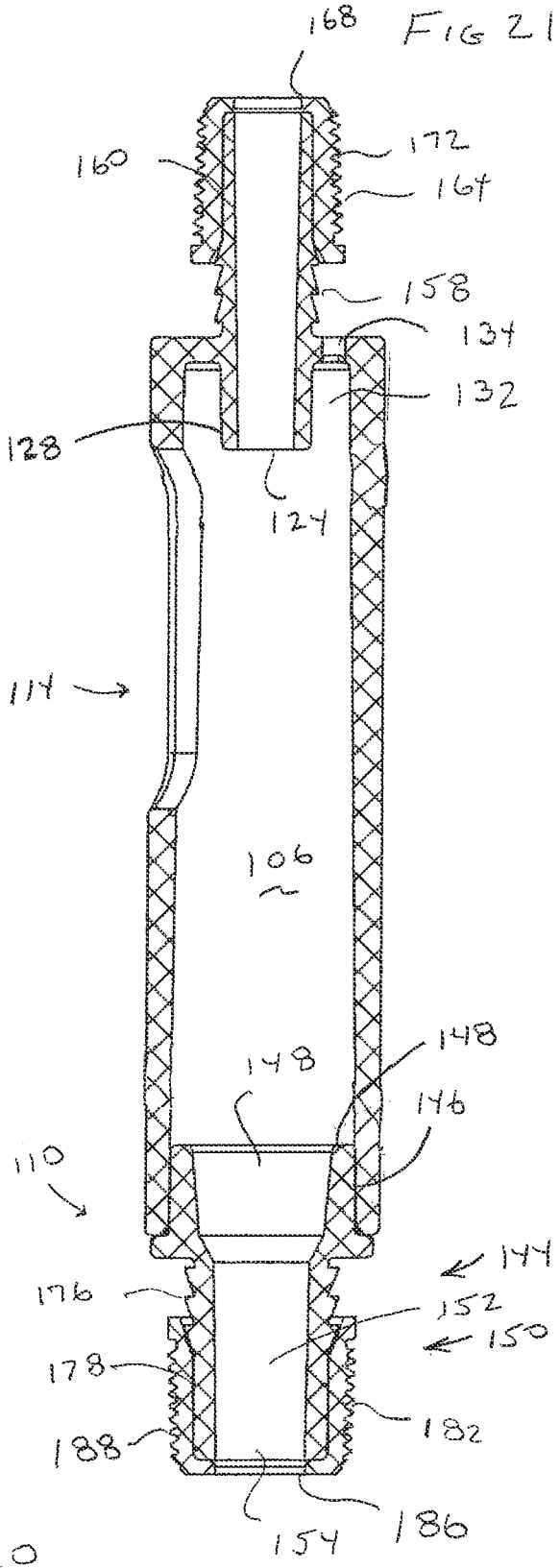
FIG. 21 is a cross section view taken along line 21-21 in FIG. 20.

As can be appreciated from FIGS. 20 and 21 for example, the exemplary inlet adapter 164 and the outlet adapter 182 enable the anti-backflow plumbing fitting 102 to be engaged with threaded liquid connectors at either or both of the inlet and outlet ends. This may be useful in some systems in which the fluid conduits include threaded female connectors. Alternatively in some applications such threaded fittings may be required for the installation of the anti-backflow fitting. It should be understood however that the adapters shown are exemplary and in other arrangements other adapter configurations may be utilized. These may include for example both externally threaded or internally threaded adapter configurations. Further it should be understood that the exemplary fitting configurations with the smooth portions may facilitate the use of connectors with annular internal resilient seals that may engage the smooth cylindrical portions in fluid tight relation. Numerous different fitting arrangements may be utilized to suit the particular system in which the anti-backflow fitting is installed.

Exemplary arrangements of anti-backflow plumbing fittings may include or be used in conjunction with features or fittings of the type discussed in U.S. patent application Ser. No. 18/051,695 filed Nov. 1, 2022, now U.S. Pat. No. 11,718,980, the disclosure of which is incorporated herein by reference in its entirety.

Thus the exemplary arrangements achieve improved operation, eliminate difficulties encountered in the use of prior devices and systems, and attain the useful results described herein.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples and the new and useful features are not limited to the exact features that have been shown or described.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes and relationships are set forth in the appended claims.

I claim:

1. Apparatus comprising:

an anti-backflow plumbing fitting, including:

a cylindrical body, wherein the cylindrical body includes a cylindrical side wall with an outside wall surface and an inside wall surface, wherein the inside wall surface bounds a fitting interior area, wherein in an operative position the body extends along a vertically extending central axis, wherein the body includes an inlet end and an outlet end, wherein the inlet end is axially opposed of the outlet end, wherein the outlet end includes a cylindrical axially extending outlet end body opening, wherein the outside wall surface at the inlet end includes a cylindrical inlet end outside wall portion, wherein the cylindrical inlet end outside wall portion is configured to be received in fluid tight engagement with a fluid delivering cylindrical recess of a liquid delivery conduit, wherein the outside wall surface at the outlet end includes a cylindrical outlet end outside wall portion, wherein the cylindrical outlet end outside wall portion is configured to be received in fluid tight engagement with a fluid receiving further cylindrical recess of a liquid removal conduit, a body inlet end wall, wherein the body inlet end wall axially bounds the interior area adjacent the inlet end, a body inlet fitting, wherein the body inlet fitting is in operatively fixed connection with the body inlet end wall, is disposed radially inward of the cylindrical inlet end outside wall portion, extends axially outward beyond the body inlet end wall, is configured to fluidly engage a liquid delivery line, includes a flow straightening inlet passage, wherein the inlet passage extends fluidly intermediate of a fitting inlet opening and an interior area inlet opening, is axially straight, and is circular in axially transverse cross section, wherein the fitting inlet opening is fluidly accessible externally of the body, is positioned axially outward beyond the cylindrical inlet end outside wall portion, and is configured to receive liquid from either the liquid delivery line or the liquid delivery conduit to which the plumbing fitting is fluidly connected, wherein the interior area inlet opening is radially disposed away from the inside wall surface, and is configured to deliver liquid directly from the inlet passage to the interior area, wherein the outlet end body opening is configured to receive therein a body outlet fitting, wherein the body outlet fitting includes a body outlet end wall, wherein the body outlet end wall includes an interior area outlet, wherein with the body outlet fitting is installed in the outlet end body opening the body outlet end wall axially bounds the interior area adjacent the outlet end, a fitting outlet opening, wherein the fitting outlet opening is accessible externally of the body, positioned axially outward beyond the outlet end outside wall portion, and configured to deliver liquid to a liquid removal line that is engaged with the body outlet fitting, an outlet passage, wherein the outlet passage extends axially and fluidly intermediate of the interior area outlet and the fitting outlet opening, wherein the fitting outlet opening is configured to deliver liquid to either the liquid removal line or to the liquid removal conduit to which the plumbing fitting is fluidly connected, an air gap opening, wherein the air gap opening extends radially through the side wall between the outside wall surface and the inside wall surface, is elongated in a direction parallel to the axis, in the operative position is bounded by a lower gap end surface, wherein the lower gap end surface is disposed axially away from the interior area outlet.

2. The apparatus according to claim 1 wherein the plumbing fitting further includes a further passage, wherein the further passage extends at the inlet end, wherein the further passage extends between an external passage opening and an internal passage opening, wherein the external passage opening is in fluid communication with an area outside the body and the internal passage opening is in fluid communication with the interior area, wherein the external passage opening is positioned radially intermediate of the interior area inlet opening and the cylindrical inlet end outside wall portion, and wherein the internal passage opening is positioned radially intermediate of the interior area inlet opening and the inside wall surface.

3. The apparatus according to claim 1 wherein the air gap opening is comprised of a single air gap opening, wherein a center line of the air gap opening is positioned in a first radial direction from the axis, wherein the plumbing fitting further includes a further passage, wherein the further passage extends at the inlet end, wherein the further passage extends between an external passage opening and an internal passage opening, wherein the external passage opening is in fluid communication with an area outside the body and the internal passage opening is in fluid communication with the interior area, wherein the external passage opening is positioned radially intermediate of the fitting inlet opening and the cylindrical inlet end outside wall portion, and wherein the internal passage opening is positioned radially intermediate of the interior area inlet opening and the inside wall surface and in a second radial direction from the axis, wherein the second radial direction is opposed of the first radial direction.

4. The apparatus according to claim 1 wherein the air gap opening is comprised of a single air gap opening, wherein a center line of the air gap opening is positioned in a first radial direction from the axis, wherein the plumbing fitting further includes a further passage, wherein the further passage extends at the inlet end, wherein the further passage extends between an external passage opening and an internal passage opening, wherein the external passage opening is in fluid communication with an area outside the body and the internal passage opening is in fluid communication with the interior area, wherein the external passage opening is positioned radially intermediate of the fitting inlet opening and the cylindrical inlet end outside wall portion, and wherein the internal passage opening is positioned radially intermediate of the interior area inlet opening and the inside wall surface and in a second radial direction from the axis, wherein the second radial direction is at least 90° from the first radial direction.

5. The apparatus according to claim 1 wherein the flow straightening inlet passage extends in an annular pipe portion in the interior area, wherein the annular pipe portion terminates axially inwardly at the interior area inlet opening, wherein an axially extending annular internal recess extends in surrounding relation of the annular pipe portion and the interior area inlet opening.

6. The apparatus according to claim 1 wherein the flow straightening inlet passage extends in an annular pipe portion in the interior area, wherein the annular pipe portion terminates axially inwardly at the interior area inlet opening, wherein an axially extending annular internal recess extends in surrounding relation of the annular pipe portion and the interior area inlet opening, wherein the plumbing fitting further includes a further passage, wherein the further passage extends at the inlet end, wherein the further passage extends between an external passage opening and an internal passage opening, wherein the external passage opening is in fluid communication with an area outside the body and the internal passage opening is in fluid communication with the axially extending annular internal recess in the interior area, wherein the external passage opening is positioned radially intermediate of the fitting inlet opening and the cylindrical inlet end outside wall portion, and wherein the internal passage opening is positioned within the axially extending annular internal recess radially intermediate of the annular pipe portion and the inside wall surface.

7. The apparatus according to claim 1 wherein the air gap opening is comprised of a single air gap opening, wherein the air gap opening is positioned in a first radial direction from the axis, wherein the flow straightening inlet passage extends in an annular pipe portion in the interior area, wherein the annular pipe portion terminates axially inwardly at the interior area inlet opening, wherein an axially extending annular internal recess extends in surrounding relation of the annular pipe portion and the interior area inlet opening, wherein the plumbing fitting further includes a further passage, wherein the further passage extends at the inlet end, wherein the further passage extends between an external passage opening and an internal passage opening, wherein the external passage opening is in fluid communication with an area outside the body and the internal passage opening is in fluid communication with the axially extending annular internal recess in the interior area, wherein the external passage opening is positioned radially intermediate of the fitting inlet opening and the cylindrical inlet end outside wall portion, and wherein the internal passage opening is positioned within the axially extending annular internal recess radially intermediate of the annular pipe portion and the inside wall surface end and in a second radial direction from the axis, wherein the second radial direction is at least 90° from the first radial direction.

8. The apparatus according to claim 1 wherein the air gap opening comprises a single opening with a circumferential width of from 10% to 25% of the circumference of the outside wall surface.

9. The apparatus according to claim 1 wherein the air gap opening comprises a single opening with a circumferential width of from 10% to 17% of the circumference of the outside wall surface.

10. The apparatus according to claim 1 wherein a minimum cross sectional area of the outlet passage is at least 2.5 times a minimum cross sectional area of the inlet passage.

11. The apparatus according to claim 1 wherein in the operative position of the plumbing fitting the flow straightening inlet passage is operative to cause liquid entering the interior area through the interior area inlet opening to move toward the interior area outlet in a linear stream that is disposed away from the air gap opening until the stream is axially beyond the lower gap end surface.

12. The apparatus according to claim 1 wherein the interior area outlet has an area greater than an area of the fitting outlet opening.

13. The apparatus according to claim 1 wherein the interior area outlet as an area at least 1.5 times greater than an area of the fitting outlet opening.

14. The apparatus according to claim 1 wherein the inlet passage and the outlet passage are axially centered relative to the cylindrical body.

15. The apparatus according to claim 1 wherein the air gap opening is bounded at an end opposed of the lower gap end surface by an upper gap end surface, wherein in the operative position of the fitting the interior area inlet opening is not above the upper gap end surface.

16. The apparatus according to claim 1 wherein the air gap opening is bounded at an end opposed of the lower gap end surface by an upper gap end surface, wherein in the operative position of the fitting the interior area inlet opening is horizontally aligned with the upper gap end surface.

17. The apparatus according to claim 1
wherein the interior area has an interior area axial length parallel to the axial direction and between body outlet end wall and the body inlet end wall which bound the interior area,
wherein the lower gap end surface is positioned in the axial direction away from the body outlet end wall a displacement distance that is the at least 40% of the interior area axial length.

18. The apparatus according to claim 1
wherein the interior area has an interior area axial length parallel to the axial direction and between the body outlet end wall and the body inlet end wall which bound the interior area,
wherein the air gap opening extends at least 50% of the interior area axial length.

19. The apparatus according to claim 1
wherein the air gap opening is bounded at an end opposed of the lower gap end surface by an upper gap end surface,
wherein in the operative position of the fitting the interior area inlet opening is horizontally aligned with the upper gap end surface,
wherein the interior area has an interior area axial length parallel to the axial direction and between the body outlet end wall and the body inlet end wall which bound the interior area,
wherein the air gap opening extends at least 50% of the interior area axial length.

20. The apparatus according to claim 1
and further comprising:
a mounting clip,
wherein the mounting clip includes
a base portion,
a pair of deformable arcuate arms that extend away from the base portion in a first direction,
wherein the arms are configured to releasably engage diametrically opposed sides of the outside wall surface.

21. The apparatus according to claim 1
wherein the body inlet fitting includes an axially outward extending cylindrical inlet portion,
wherein the cylindrical inlet portion
extends in surrounding relation of at least a portion of the inlet passage,
terminates axially outward at the fitting inlet opening,
includes a cylindrical inlet portion outer surface,
wherein the cylindrical inlet portion outer surface includes
an axially elongated barbed portion including a plurality of axially spaced annular radially outward extending barbs, and
an axially elongated smooth portion,
wherein the smooth portion is disposed axially closer to the fitting inlet opening than the barbed portion.

22. The apparatus according to claim 1
wherein the body inlet fitting includes an axially outward extending cylindrical inlet portion,
wherein the cylindrical inlet portion
extends in surrounding relation of at least a portion of the inlet passage,
terminates axially outward at the fitting inlet opening,
includes a cylindrical inlet portion outer surface,
wherein the cylindrical inlet portion outer surface includes
an axially elongated barbed portion including a plurality of axially spaced annular radially outward extending barbs,
wherein the barbed portion is configured to engage a flexible liquid delivery line, and
an axially elongated smooth portion,
wherein the smooth portion is disposed axially closer to the fitting inlet opening than the barbed portion,
wherein the smooth portion is configured to engage an externally threaded adapter in fluid tight relation.

23. The apparatus according to claim 1
wherein the body outlet fitting includes an axially outward extending cylindrical outlet portion,
wherein the cylindrical outlet portion
extends in surrounding relation of at least a portion of the outlet passage,
terminates axially outward at the fitting outlet opening,
includes a cylindrical outlet portion outer surface,
wherein the cylindrical outlet portion outer surface includes
an axially elongated barbed portion including a plurality of axially spaced annular radially outward extending barbs,
wherein the barbed portion is configured to engage a flexible liquid outlet line, and
an axially elongated smooth portion,
wherein the smooth portion is disposed axially closer to the fitting outlet opening than the barbed portion,
wherein the smooth portion is configured to engage an externally threaded adapter in fluid tight relation.

24. Apparatus comprising:
an anti-backflow plumbing fitting, including:
a cylindrical body, wherein the cylindrical body includes a cylindrical side wall with an outside wall surface and an inside wall surface, wherein the inside wall surface bounds a fitting interior area,
wherein in an operative position the body extends along a vertically extending central axis,
wherein the body includes an inlet end and an outlet end, wherein the inlet end is axially opposed of the outlet end,
wherein the outlet end includes an outlet end body opening,
a body inlet end wall, wherein the body inlet end wall axially bounds the interior area adjacent the inlet end,
a body inlet fitting, wherein the body inlet fitting
is in operatively fixed connection with the body inlet end wall,
extends axially outward beyond the body inlet end wall,
is configured to fluidly engage a liquid delivery line,
an axially extending inlet passage, wherein the inlet passage extends through the body inlet end wall and intermediate of a fitting inlet opening of the body inlet fitting that is accessible externally of the body and that is configured to receive liquid from the liquid delivery line, and an interior area inlet opening configured to deliver liquid from the inlet passage to the interior area,
wherein the interior area inlet opening is radially disposed away from the inside wall surface,
a further passage, wherein the further passage extends at the inlet end, wherein the further passage extends between an external passage opening and an internal passage opening, wherein the external passage opening is in fluid communication with an area outside the body and the internal passage opening is in fluid communication with the interior area, wherein the external passage opening is positioned radially intermediate of the fitting inlet opening and the inside wall surface, and wherein the internal passage opening is positioned radially intermediate of the interior area inlet opening and the inside wall surface and is disposed in a radial direction from the axis, a body outlet fitting, wherein the body outlet fitting is configured to extend in the outlet end body opening, wherein the body outlet fitting includes a body outlet fitting end wall, wherein with the body outlet fitting positioned in the outlet end body opening the body outlet fitting end wall axially bounds the interior area adjacent the outlet end, wherein the body outlet end wall includes an interior area outlet, an axially elongated cylindrical outlet portion, wherein the outlet portion extends axially outward beyond the body fitting outlet end wall and is configured to engage a liquid removal line, an outlet passage, wherein the outlet passage extends within the outlet portion and axially intermediate of the interior area outlet and a fitting outlet opening that is accessible externally of the body and is configured to deliver liquid to a liquid removal line, an air gap opening, wherein the air gap opening is comprised of a single air gap opening, extends through the side wall between the outside wall surface and the inside wall surface, is elongated in a direction parallel to the axis, is positioned in a further radial direction from the axis, wherein the further radial direction is opposed of the radial direction, and is bounded by a lower gap end surface, wherein the lower gap end surface is disposed axially away from the interior area outlet.

25. The apparatus according to claim 24 wherein the outside wall surface at the inlet end includes a cylindrical inlet end outside wall portion, wherein the outside wall surface at the outlet end includes a cylindrical outlet end outside wall portion, wherein the cylindrical inlet end wall portion is configured to be received in fluid tight engagement with a fluid delivering cylindrical recess of a liquid delivery conduit, wherein in the operative position of the fitting and in engagement with the liquid delivery conduit, liquid is receivable into the interior area through both the fitting inlet opening and the further passage, and wherein the cylindrical outlet end outside wall portion is configured to be received in fluid tight engagement with a further cylindrical recess of a liquid removal conduit, wherein in the operative position and in engagement with the liquid removal conduit, liquid from the interior area is receivable into the liquid removal conduit from the outlet end body opening regardless of whether the body outlet fitting is positioned in the outlet end body opening.

26. The apparatus according to claim 25 wherein the inlet passage has a minimum inlet cross sectional area and the outlet passage has a minimum outlet cross sectional area, wherein the minimum outlet cross sectional area is at least 250% of the minimum inlet cross sectional area.

27. The apparatus according to claim 25 wherein the inlet passage includes a flow straightening portion intermediate of the fitting inlet opening and the interior area inlet opening, wherein liquid entering the interior area through the interior area inlet opening is caused to move axially in a linear stream in the interior area toward the outlet end until the liquid is below the air gap opening.

28. The apparatus according to claim 25 wherein one of the inlet fitting and the axially elongated cylindrical outlet portion includes an axially elongated outer surface, wherein the axially elongated outer surface includes a barbed portion including a plurality of axially spaced annular radially outward extending barbs, and a smooth portion including an axially elongated smooth outer cylindrical surface, wherein the barbed portion is positioned axially closer to the body and is configured to engage a flexible fluid line, and wherein the smooth portion is configured to engage an externally threaded adapter in fluid tight relation.

* * * * *